US009788376B2

(12) United States Patent
Mio

(10) Patent No.: US 9,788,376 B2
(45) Date of Patent: Oct. 10, 2017

(54) LED BACKLIGHT DRIVING CIRCUIT, LIQUID CRYSTAL DISPLAY DEVICE, AND METHOD OF DRIVING A DRIVING CIRCUIT

(71) Applicant: NLT TECHNOLOGIES, LTD., Kawasaki, Kanagawa (JP)

(72) Inventor: Setsuko Mio, Kawasaki (JP)

(73) Assignee: NLT TECHNOLOGIES, LTD., Kanagawa (JP)

( * ) Notice: Subject to any disclaimer, the term of this patent is extended or adjusted under 35 U.S.C. 154(b) by 0 days.

(21) Appl. No.: 15/172,256

(22) Filed: Jun. 3, 2016

(65) Prior Publication Data

US 2016/0366740 A1 Dec. 15, 2016

(30) Foreign Application Priority Data

Jun. 9, 2015 (JP) ..... 2015-116803

(51) Int. Cl.
*H05B 33/08* (2006.01)
*G09G 3/00* (2006.01)
*H05B 41/282* (2006.01)

(52) U.S. Cl.
CPC ..... *H05B 33/0827* (2013.01); *G09G 3/00* (2013.01); *H05B 33/0851* (2013.01); *H05B 41/2828* (2013.01)

(58) Field of Classification Search
CPC ..... H05B 33/0815; H05B 33/0845; H05B 33/0851; H05B 33/0827; H05B 33/0812; H05B 33/0884; H05B 33/0866; H05B 33/0863; H05B 41/2828; H05B 41/3921
USPC .... 315/247, 224, 225, 209 R, 291, 307–326, 315/DIG. 4
See application file for complete search history.

(56) References Cited

U.S. PATENT DOCUMENTS

2010/0219764 A1 9/2010 Yamasaki et al.
2011/0062887 A1* 3/2011 Hsu ..... H05B 33/0818 315/294
2011/0309758 A1* 12/2011 Yu ..... H05B 33/0827 315/192
2013/0250215 A1* 9/2013 Sasaki ..... H05B 33/0815 349/69

(Continued)

FOREIGN PATENT DOCUMENTS

JP 2008-047494 A 2/2008
JP 2009-123681 A 6/2009
JP 5030623 B2 9/2012

*Primary Examiner* — Tuyet Vo
(74) *Attorney, Agent, or Firm* — Sughrue Mion, PLLC

(57) ABSTRACT

An example LED backlight driving circuit includes: an LED circuit including a plurality of LED columns that are connected in parallel, each of LED column including one or more LEDs that are connected in series; an LED control circuit connected to constant current circuits corresponding to a parallel number of the LED columns, the LED control circuit including a circuit that controls ON/OFF of a driving current of the LED and a dimming determination circuit that outputs a control signal capable of arbitrarily setting the driving current according to a dimming signal. The LED control circuit performs control based on first driving in which dimming is performed by varying a current value of the driving current of the LED and second driving in which the ON/OFF of the driving current is controlled in addition to the varying of the current value.

10 Claims, 22 Drawing Sheets

(56) References Cited

U.S. PATENT DOCUMENTS

2015/0216009 A1* 7/2015 Lee ..... H05B 33/0845
315/307

* cited by examiner

DIMMING DETERMINATION CIRCUIT 10

LED BACKLIGHT DRIVING CIRCUIT, LIQUID CRYSTAL DISPLAY DEVICE, AND METHOD OF DRIVING A DRIVING CIRCUIT

CROSS-REFERENCE TO RELATED APPLICATIONS

This non-provisional application claims priority under 35 U.S.C. §119(a) on Patent Application No. 2015-116803 filed in Japan on Jun. 9, 2015, the entire contents of which are hereby incorporated by reference.

FIELD

The technology herein relates to an LED backlight driving circuit, a liquid crystal display device, and a method of driving a driving circuit.

BACKGROUND

In a liquid crystal display device using a LED backlight, methods of controlling brightness of an LED are roughly divided into two types of methods, that is, a pulse current dimming scheme and a constant current dimming scheme. In the pulse current dimming scheme (hereinafter, "PWM dimming"), visual brightness is controlled by changing a percentage of an ON period and an OFF period of an electric current, that is, a duty ratio while maintaining a current value of an electric current flowing through an LED to be constant. In the constant current scheme (hereinafter, "constant current dimming"), visual brightness is controlled by changing a current value of an electric current flowing an LED.

In the PWM dimming, switching control of the ON period is consequential, and thus an accurate adjustment is possible, and an LED current is constant during the ON period. Further, in the PWM dimming, since there is no change in characteristics of the LED at the time of lighting, it is easy to control chromaticity or the like, and the PWM dimming is widely used as a current dimming scheme. However, in the PWM dimming, a dimming ratio is restricted according to a rising/falling time of a driving current, and thus the dimming ratio may not be sufficiently obtained. As a solution to this problem, there is a technique of increasing a dimming range by simultaneously controlling a pulse and an electric current such that a driving current value is decreased while decreasing the duty ratio of the PWM.

In addition, the PWM dimming has a problem in that flickering is seen by some people. Further, in the PWM dimming, as the current value of the electric current flowing through the LED increases (luminance increases), a current change at the time of ON/OFF increases, and thus ripples are likely to overlap at a power source circuit side. Thus, in the PWM dimming, there is a problem in that a ringing sound is likely to be generated in a circuit member such as a capacitor or a coil. For this reason, there are recently cases where, in order to prevent flickering of the LED or an ON/OFF change of the LED current, a constant current dimming scheme of increasing only the driving current without performing pulse width modulation of the driving current and controlling luminance of the LED is used. In the constant current dimming scheme, the voltage/current ripples, the ringing sound, and visibility are improved, but since an electric current is controlled in an analogue manner, an electric current error has directly influence on luminance characteristics of the LED. Thus, it is harder to perform control at a low luminance side (a low current value) than in the PWM dimming, and there is a problem in that luminance is likely to be uneven.

In the case of dimming an LED backlight with a plurality of parallel LED circuits, it is necessary to simultaneously perform dimming of a plurality of current sources, that is, a plurality of constant current circuits. If the dimming is performed according to the constant current dimming scheme, due to individual differences of the constant current circuits, there is a difference in the driving current value, and thus the respective LED columns differ in luminance. Thus, the constant current dimming scheme has a problem in that the in-plane luminance of the entire LED backlight becomes uneven.

For example, when the LED backlight is driven using two constant current circuits A and B driving 100 mA at dimming of 100%, due to an error between the circuits, if the driving current of 101 mA and the driving current of 99 mA flow through the circuits A and B, respectively, at dimming of 100%, an error between the circuits is 2 mA, and a luminance difference with respect to the driving current is about 2%. However, when 11 mA and 9 mA flows through the circuits A and B, respectively, at dimming of 10%, the luminance difference with respect to the driving current is close to 20% even there is the same error, that is, 2 mA. In other words, when the difference (error) in the current between the constant current circuits is almost constant regardless of the dimming ratio, as the driving current value is decreased at the time of low dimming (at the time of a low current), the ratio of the current difference of the driving current value between the constant current circuits with respect to the driving current value is increased, and the current difference is likely to be particularly remarkably seen as a luminance difference, leading to luminance unevenness. Since an error of a current value of a neighboring LED is often viewed as unevenness even at 10%, depending on an in-plane luminance design of the entire backlight, it is difficult to use low dimming of less than 20% in the constant current circuit having the error of 2 mA.

As the solutions to this problem, there are a technique of averaging a difference in luminance by alternately switching a current source and an LED through a switch and performing driving in a time division manner and a technique of removing a difference between current sources by driving a plurality of LEDs in a time division manner with respect to one current source.

In the former, it is solved by alternately switching a current source and an LED when a parallel number is 2, but as the parallel number increases, control and a combination of alternate driving become more complicated, and thus a circuit size is likely to increase significantly. In the latter, the ON period of the electric current for each of the LEDs that are connected in parallel is necessarily the reciprocal of the parallel number, and a maximum luminance of the backlight is commonly equal to or less than half of the luminance when the LED is constantly turned on, and thus it is difficult to use luminous efficiency sufficiently. Further, the known example is under the assumption of a method of performing dimming according to a time interval or a pulse width and thus deals with neither a problem nor a solution at the time of low dimming in a dimming scheme based on an increase in an electric current.

As a solution to a variation in brightness at the time of low luminance dimming in the constant current dimming, there is a technique of causing an electric current of a pulse form to flow through an LED at the time of low luminance and performing dimming by changing an average value (that is, a duty ratio or a frequency) of pulse waveforms. This known example is an effective method in securing linearity and reproducibility of dimming-luminance characteristics of an LED. However, the method of performing dimming based on the duty ratio or the frequency is the same scheme as the conventional PWM dimming, and still has the problem such as a noise, a ringing sound, flicking, or ripples. Further, there is a problem in that since the LED current value (peak value) is constant when dimming is performed based on a pulse average value, the differences in the electric current at the time of low luminance is not improved when a plurality of parallel LEDs are driven by a plurality of constant current circuits.

SUMMARY

According to one aspect of an embodiment of the present disclosure, an electric current of an LED is controlled such that at the time of low luminance (small current) driving influencing a difference in in-plane luminance, ON/OFF of a driving current of an LED is controlled by performing switching control of each constant current circuit, and switching to a method of performing sequence driving of an LED is performed.

An current ON period (a pulse width) of systems (parallel) at the time of sequence driving is set to the reciprocal of the number of systems (the parallel number), and the current value is set to a current value proportional to the number of systems (the parallel number) necessary for desired luminance. Further, control is performed such that an OFF period (an extinction period) is not provided in terms of the entire LED circuit.

It is to be understood that both the foregoing general description and the following detailed description are exemplary and explanatory and are not restrictive of disclosure.

The above and further objects and features will more fully be apparent from the following detailed description with reference to the accompanying drawings.

DETAILED DESCRIPTION OF NON-LIMITING EXAMPLE EMBODIMENTS

First Embodiment

<Configuration of First Embodiment>

Figure 1:
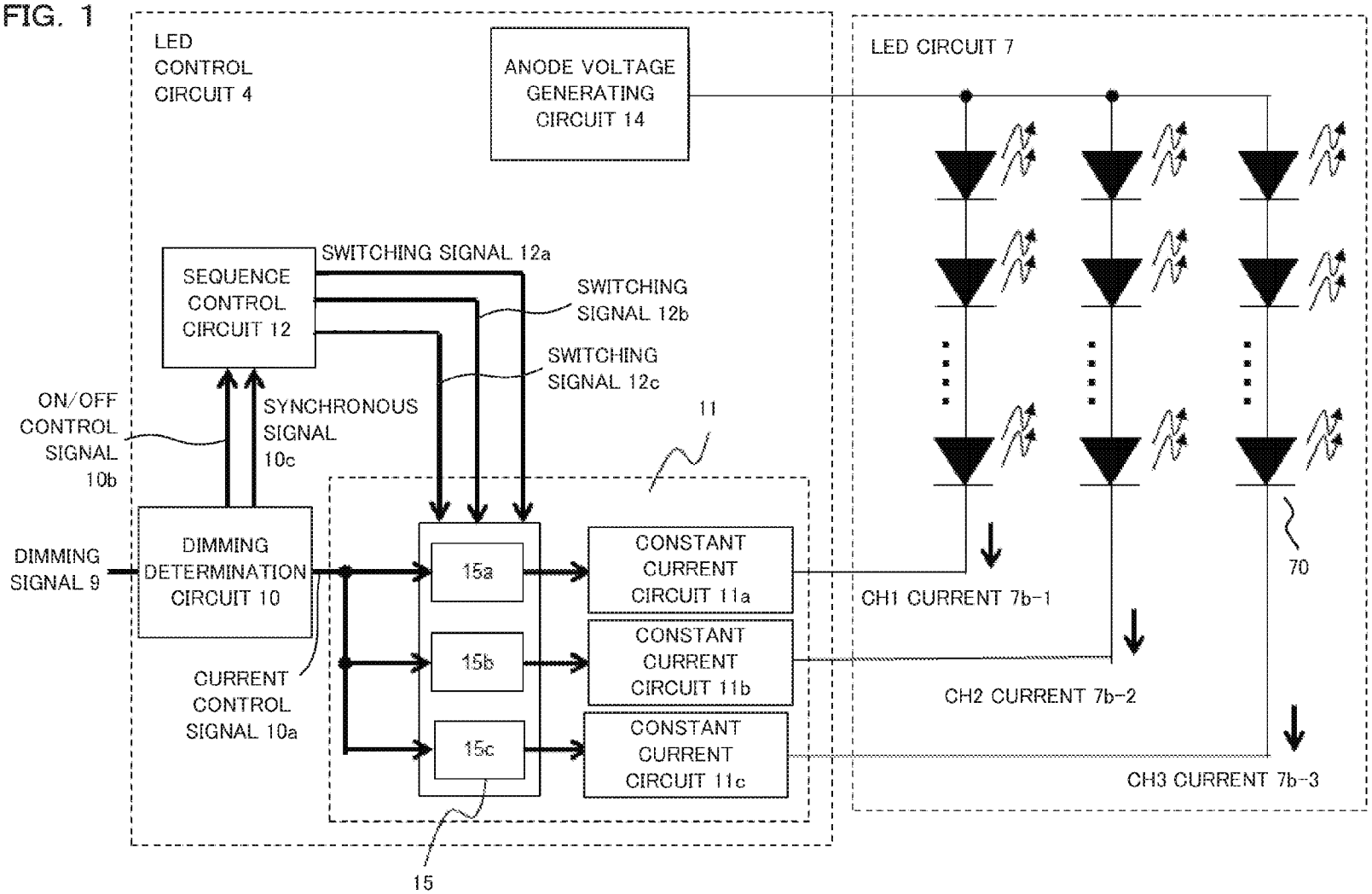
FIG. 1 is a diagram illustrating a configuration of an example of LED backlight driving circuit according to a first embodiment.

FIG. 1 is a diagram illustrating a configuration of an example of LED backlight driving circuit according to a first embodiment. LEDs 70 of an LED circuit 7 are dimmed based on a voltage and an electric current generated by an LED control circuit 4. The LED control circuit 4 includes a constant current circuit 11, a dimming determination circuit 10, a sequence control circuit 12, and an anode voltage generating circuit 14. As the anode voltage generating circuit 14 applies a voltage to an anode side of the LEDs, and the constant current circuit 11 causes an electric current to flow from a cathode side of each LED column, the LEDs 70 are turned on. Further, luminance of each LED column is controlled by varying the current value. The dimming determination circuit 10 decides whether or not sequence control is performed, and decides an LED driving current value. When the sequence control is performed, dimming of the entire LED circuit 7 is performed such that the sequence control circuit 12 performs ON/OFF control of each constant current circuit, and performs ON/OFF control of an LED driving current.

Figure 2:
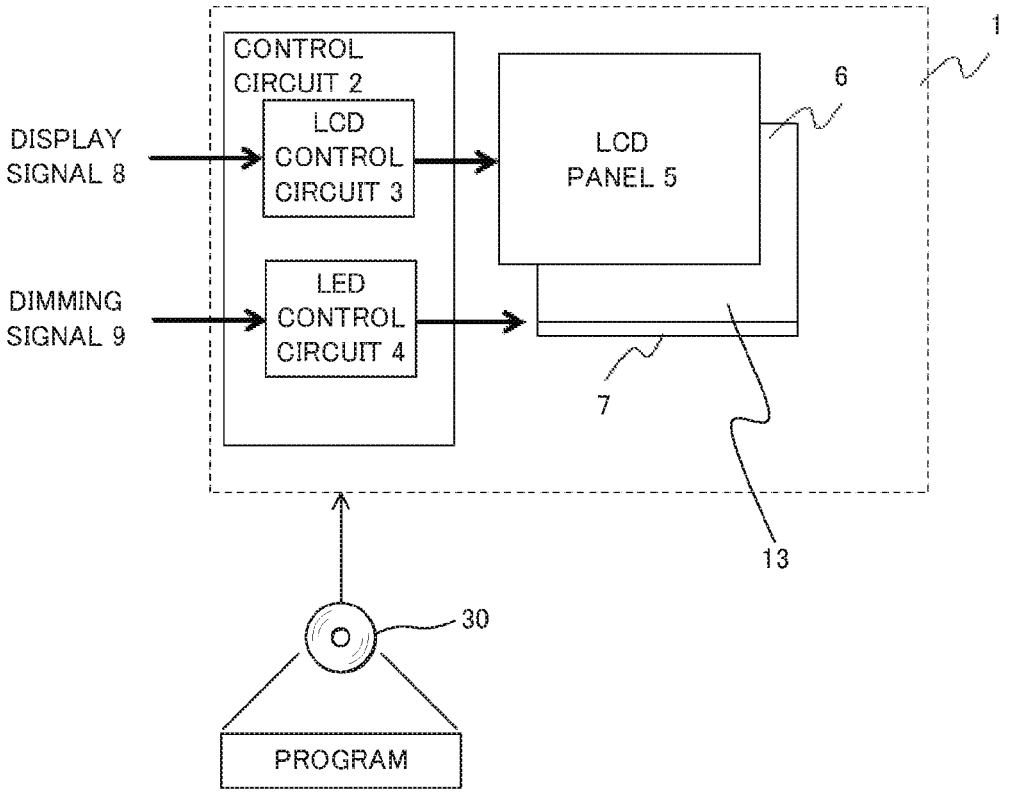
FIG. 2 is an explanatory diagram of a liquid crystal display device according to the first embodiment.

FIG. 2 is a diagram illustrating an overall configuration of a liquid crystal display device according to the first embodiment. A liquid crystal display device 1 includes an LCD panel 5, an LED backlight 6, and a control circuit 2. The LED circuit 7 is mounted in the LED backlight 6. The control circuit 2 includes an LCD control circuit 3 and the LED control circuit 4. Based on a display signal 8, the LCD control circuit 3 transfers a signal, a voltage, or the like to the LCD panel 5 and control a display of the LCD. Based on a dimming signal 9, the LED control circuit 4 applies, for example, a driving signal and a voltage for dimming the LED backlight 6 to the LED circuit 7. LCD control circuit 3, LED control circuit, and LED circuit 7 perform operations based on the program stored in a recording medium 30 such as a CD (Compact Disc)-ROM, a DVD (Digital Versatile Disc)-ROM, a BD (Blu-ray® Disc), a hard disc drive, or a solid state drive which corresponds to a portable medium as a computer readable medium. For example, the LED control circuit 4 performs an operation which will be described later based on a program stored in a storage medium 30 and executing the program through a CPU.

In the liquid crystal display device 1, the LED control circuit 4 and the LED circuit 7 configure the LED backlight driving circuit. The LED backlight 6 includes a backlight unit 13 (which is not illustrated in detail) including a backlight chassis in which a light guide plate converting light emitted from the LED 70 into a surface light source is accommodated and a reflecting sheet, a prism sheet, and the like that are arranged on the back surface and the front surface of the light guide plate and used for effectively using the light emitted from the LED 70 in addition to the LED circuit 7.

Figure 3:
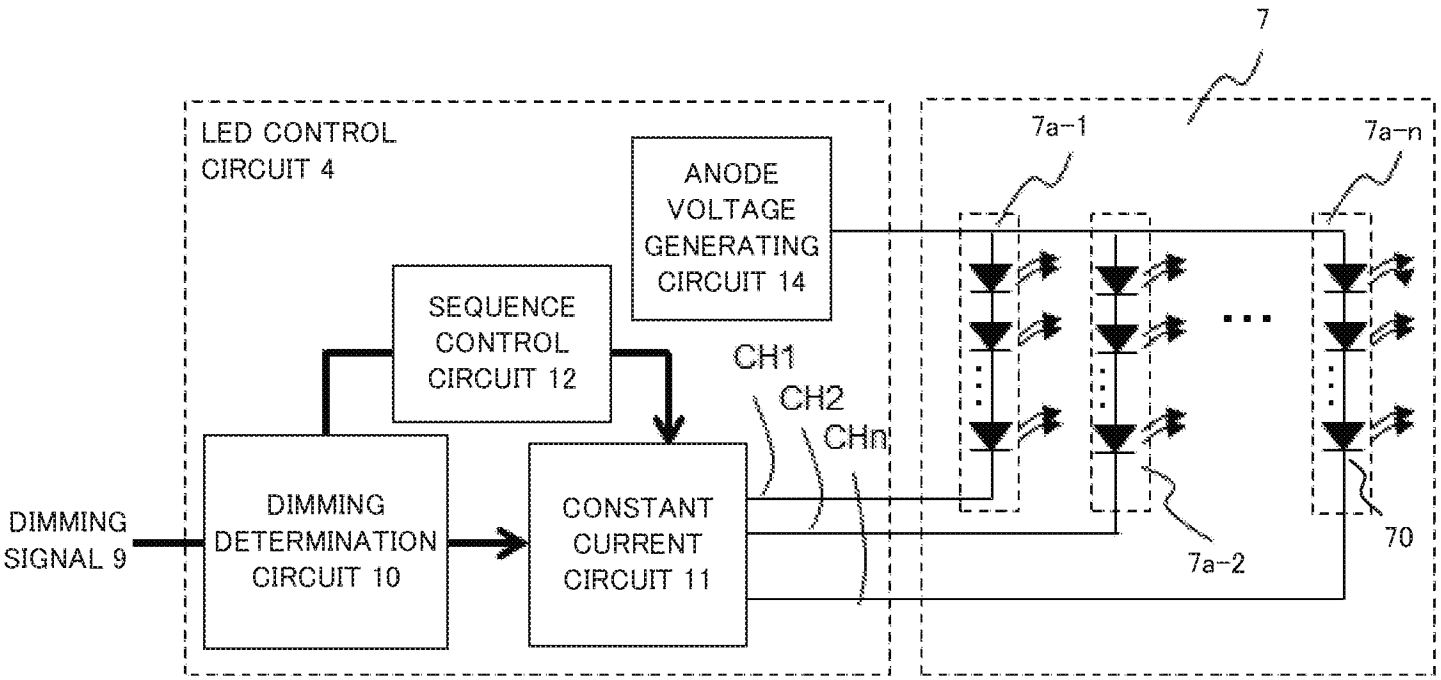
FIG. 3 is a detailed diagram of an LED control circuit and an LED circuit according to the first embodiment.

FIG. 3 is a diagram illustrating a connection relation between the internal components of the LED control circuit 4 and the LED circuit 7. The LED control circuit 4 includes the dimming determination circuit 10, the constant current circuit 11, the sequence control circuit 12, and the anode voltage generating circuit 14. The LED circuit 7 is configured such that two or more columns of LED groups 7*a*-1 to 7*a*-*n* in which one or more LEDs 70 are connected in series are connected in parallel. As the anode voltage generating circuit 14 applies the voltage to the anode side of the LED group of the LED circuit 7, the cathode sides of the LEDs 70 connected in parallel are connected to the constant current circuit 11, and the constant current circuit 11 causes the electric current to flow, the LED 70 is turned on. The dimming determination circuit 10 and the sequence control circuit 12 generate a control signal for driving the constant current circuit 11 based on a dimming ratio input from the dimming signal 9. Here, the dimming ratio indicates the duty ratio of the dimming signal 9.

Figure 4:
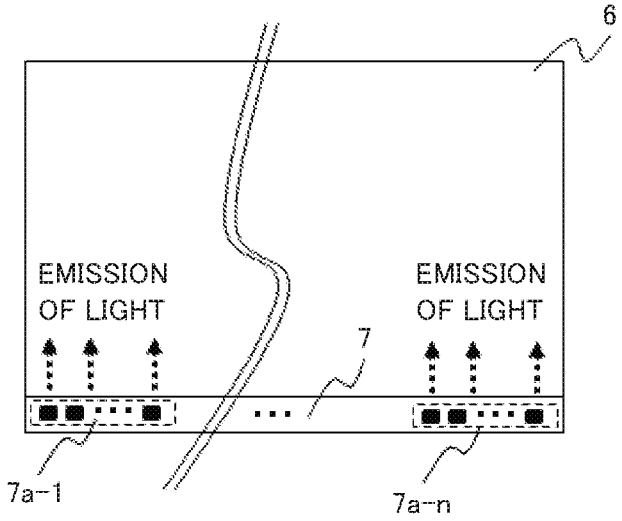
FIG. 4 is an explanatory diagram of an LED backlight and an LED circuit.

FIG. 4 is a diagram illustrating an arrangement of the LEDs 70 in the LED backlight 6. The LED circuit 7 is arranged in a line on one end or both ends of the LED backlight 6, and the LED groups 7*a*-1 to 7*a*-*n* are arranged together in units of blocks in order from the end. As the LED groups are individually driven, the entire plane of the LED backlight 6 emits light.

<Description of Operation of First Embodiment>

FIG. 1 illustrates a configuration when the LED circuit 7 has a configuration in which a parallel number is 3. The constant current circuit 11 includes constant current circuits 11*a*, 11*b*, and 11*c* of three channels according to the parallel number. The dimming determination circuit 10 decides whether or not the sequence control is performed based on the dimming signal 9 given from the outside. The dimming determination circuit 10 generates a current control signal 10*a*, and the current control signal 10*a* is input to the respective constant current circuit 11. The dimming determination circuit 10 further generates an ON/OFF control signal 10*b* and a synchronous signal 10*c*, and inputs the ON/OFF control signal 10*b* and the synchronous signal 10*c* to the sequence control circuit 12. The sequence control circuit 12 generates switching signals 12*a*, 12*b*, and 12*c* for the respective LED columns based on the ON/OFF control signal 10*b* and the synchronous signal 10*c*. The switching signals 12*a*, 12*b*, and 12*c* are input to the constant current circuits 11*a*, 11*b*, and 11*c* of the respective LED columns of the constant current circuit 11.

Figure 5:
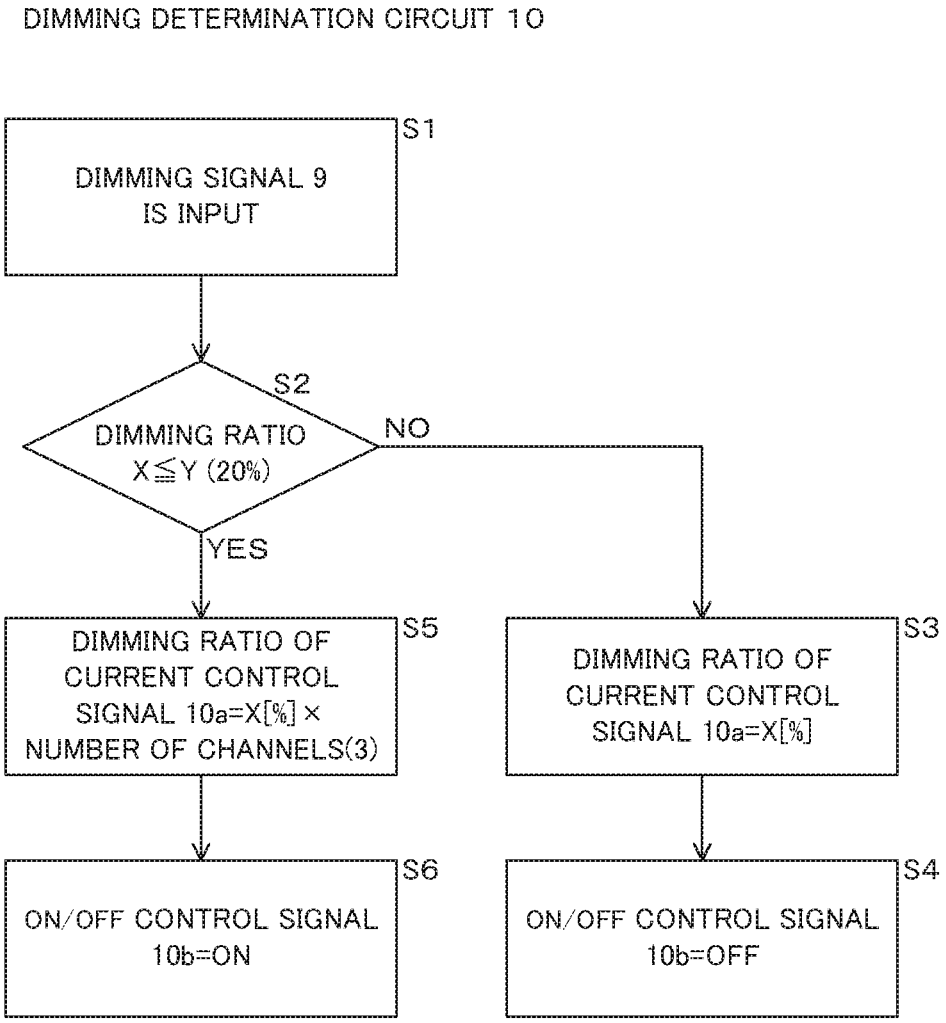
FIG. 5 is an operation flowchart of a dimming determination circuit.
Figure 6:
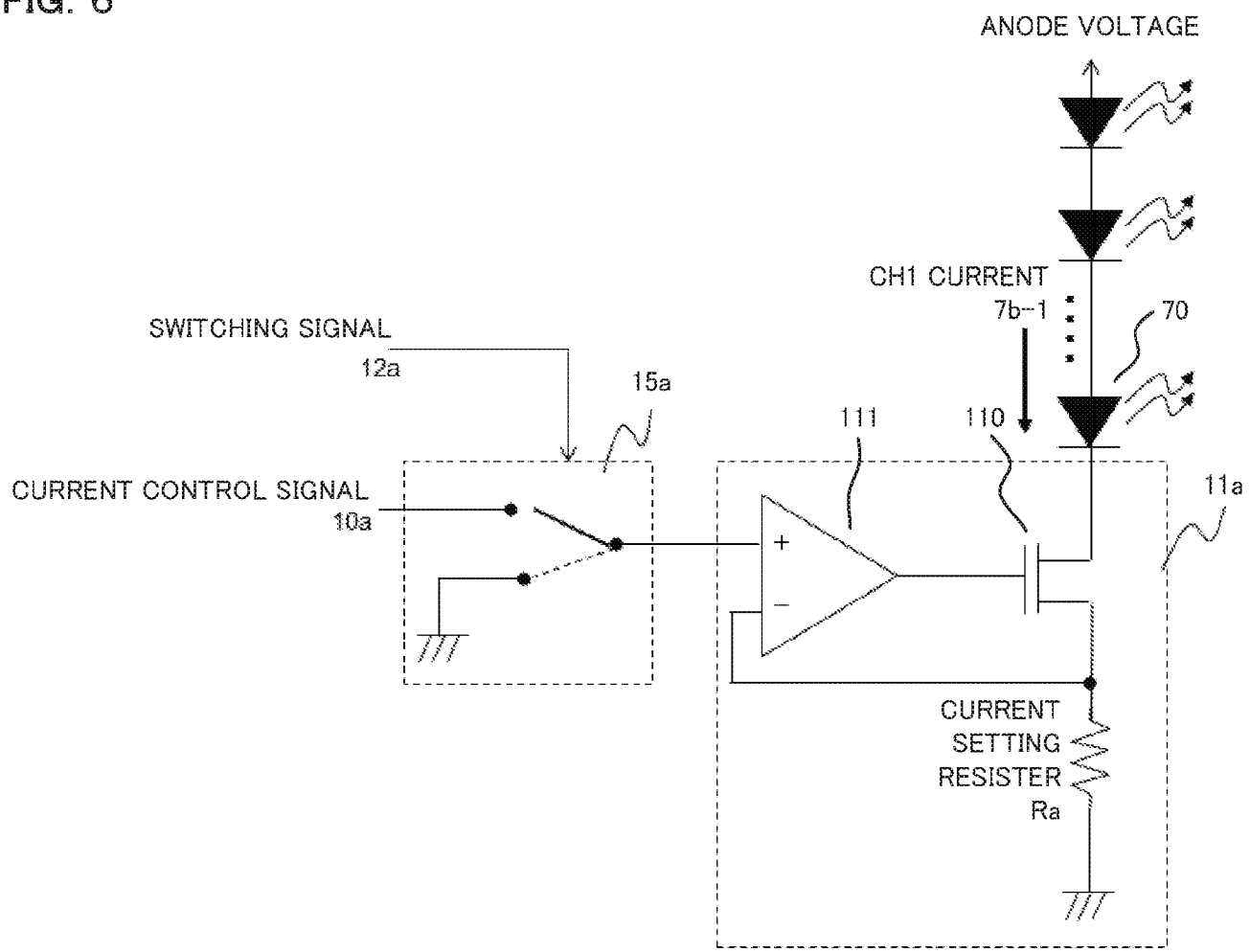
FIG. 6 is a detailed diagram of a constant current circuit.

FIG. 5 illustrates an operation flow of the dimming determination circuit 10, and FIG. 6 illustrates the details of the constant current circuit 11*a*. The dimming determination circuit 10 determines whether or not information Y of a dimming ratio X of the dimming signal 9 applied from the outside is a certain constant dimming ratio. A dimming ratio serving as a determination threshold value is a constant value held in the dimming determination circuit 10. Here, the threshold value is assumed to be 20% as an example. As illustrated in FIG. 5, the dimming signal 9 is input to the dimming determination circuit 10 (S1). In other words, the dimming determination circuit 10 acquires the dimming signal 9. The dimming determination circuit 10 calculates the dimming ratio X % based on the acquired dimming signal 9. Thereafter, the dimming determination circuit 10 determines whether or not the dimming ratio X is equal to or less than Y [%] (here, 20%) (S2). If the dimming determination circuit 10 determines the dimming ratio X to be neither equal to nor less than Y (S2: NO), the current value of the same percentage as the input dimming ratio X is set as the dimming ratio of the current control signal 10*a* (S3). Similarly, the ON/OFF control signal 10*b* is set to OFF (S4), the sequence driving is not performed, and the LED driving current is constantly set to ON. In other words, the driving current of the current value set based on the dimming ratio is supplied to each LED column. It is referred to a "first driving scheme."

If the dimming determination circuit 10 determines the dimming ratio X to be equal to or less than Y [%] (here, 20%) (S2: YES), the dimming ratio of the current control signal 10*a* to be transferred is set to be in proportion to the number of channels (here, three times since the number of channels is 3) (S5) and transferred to the constant current circuit 11. At the same time, the ON/OFF control signal 10*b* is set to ON (S6) and transferred to the sequence control circuit 12. If the ON/OFF control signal 10*b* is ON, the current value set based on the dimming ratio X is controlled to be the current value based on the parallel number of the LED columns and sequentially supplied to the respective LED columns. It is referred to as a "second driving scheme." In other words, switching between the first driving scheme and the second driving scheme is controlled according to the dimming ratio.

The constant current circuits 11*a*, 11*b*, and 11*c* are the same circuits, and FIG. 6 representatively illustrates a relation between the constant current circuit 11*a* and a switch 15*a*. The constant current circuit 11*a* includes an FET 110, an operational amplifier 111, and a current setting resistor Ra. A drain of the FET 110 is connected to the cathode side to the LED 70, and a source thereof is connected to the current setting resistor Ra. An output of the operational amplifier 111 is connected to a gate of the FET 110. A non-inverting input terminal of the operational amplifier 111 is connected to the switch 15*a*, and an inverting input terminal is connected to a connection point of the source of the FET 110 and the current setting resistor Ra. The switch 15*a* has an ON/OFF function of the current control signal 10*a* on the non-inverting input terminal of the operational amplifier 111 of the constant current circuit 11*a*. When the current control signal 10*a* is ON, the dimming determination circuit 10 and the non-inverting input terminal are connected, and when the current control signal 10*a* is OFF, the non-inverting input terminal is grounded. The constant current circuit 11*b* and a switch 15*b*, as well as the constant current circuit 11*c* and a switch 15*c* have a similar relation.

In the operation of the constant current circuit 11*a*, when the current control signal 10*a* is input, the same voltage level is generated in the current setting resistor Ra. Thus, a ch1 current 7b-1 serving as the LED driving current is expressed by the following equation:

$$7b\text{-}1[A]=10a[V]/Ra[\Omega]$$

Here, since a resistance value of Ra is constant, the current 7b-1 can arbitrarily be varied based on the value of the current control signal 10a. Further, ON/OFF of the electric current is controlled by switching the connection of the switch 15a at the previous stage of the constant current circuit 11a by the switching signal 12a from the sequence control circuit 12 in the constant current circuit 11a.

Figure 7:
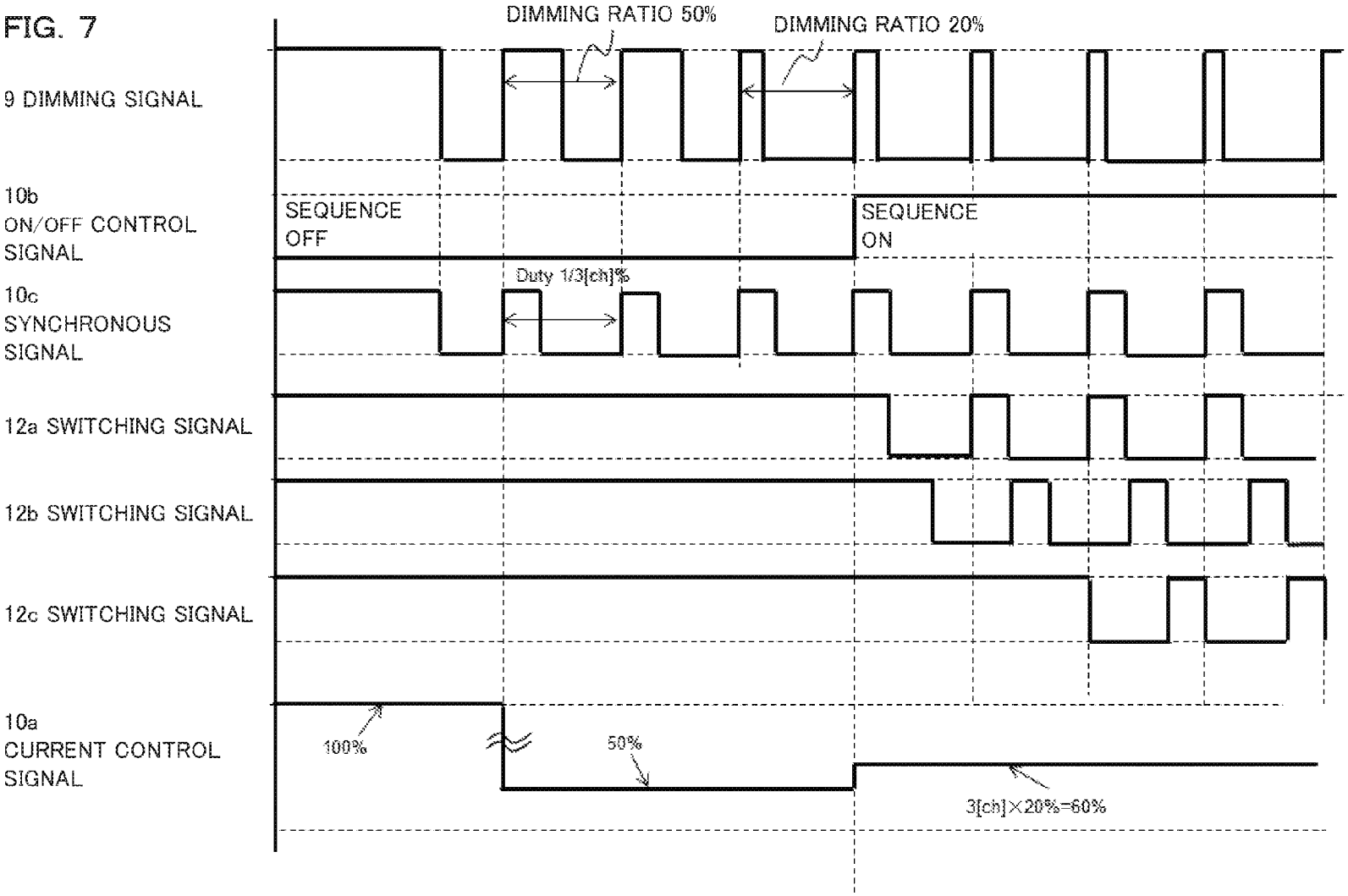
FIG. 7 is a timing chart (1/2) according to the first embodiment.
Figure 8:
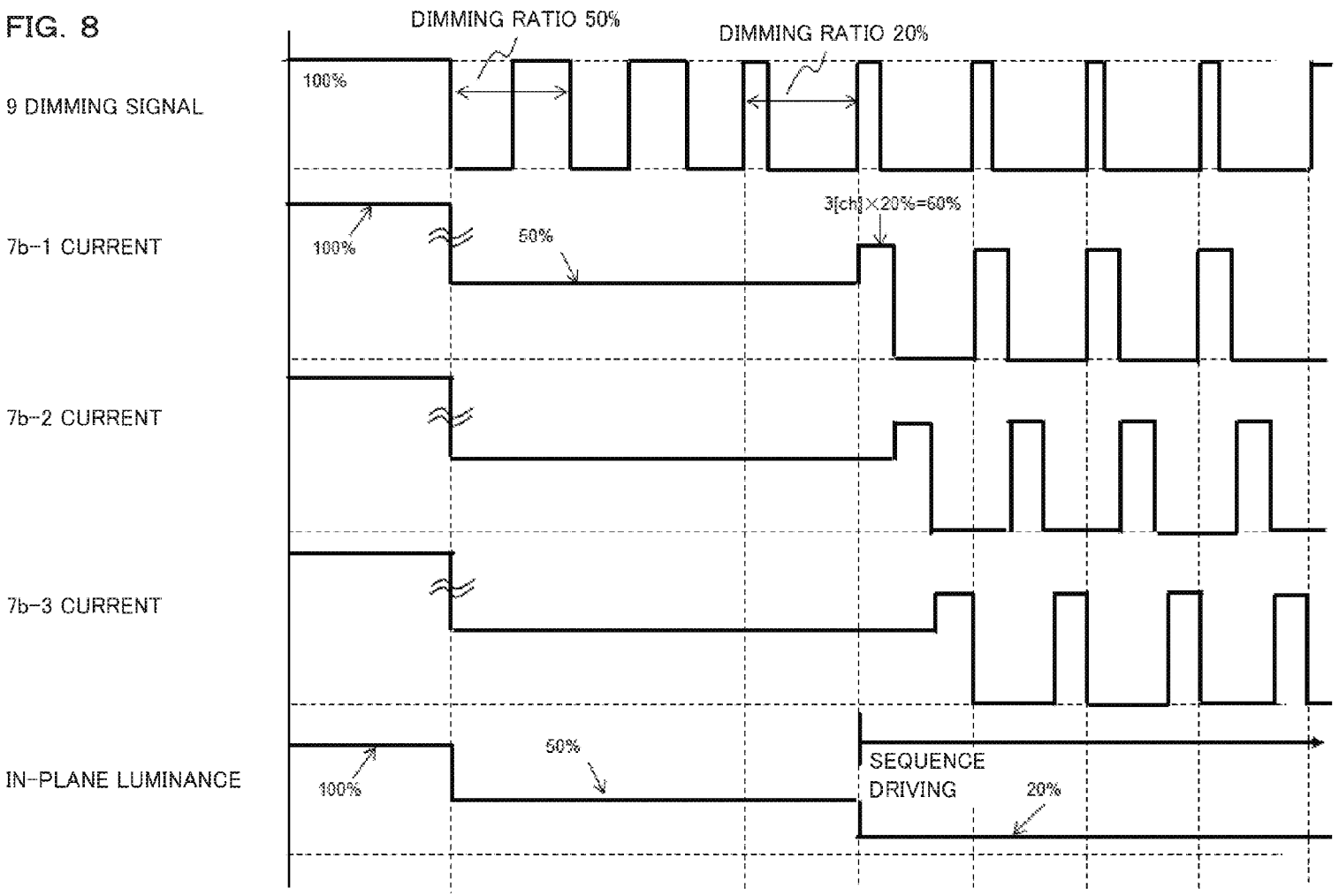
FIG. 8 is a timing chart (2/2) according to the first embodiment.

FIGS. 7 and 8 illustrate a timing chart of an overall operation of the LED control circuit 4. First, when dimming is performed in a state where the dimming signal 9 is less than 100%, the synchronous signal 10c having the ON period of the reciprocal of the parallel number is generated based on the cycle of the dimming signal 9. Further, the ON/OFF control signal 10b is generated based on the determination result according to the dimming ratio. When the dimming signal 9 becomes the determination threshold value (20%) of the determination circuit 10, the ON/OFF control signal 10b is set to ON. The sequence control circuit 12 generates the switching signals 12a, 12b, and 12c for performing the sequence driving by the constant current circuit 11 based on the two signals. The dimming determination circuit 10 generates the current control signal 10a for driving with the current value proportional to the parallel number, and inputs the current control signal 10a to the constant current circuit 11.

As the current control signal 10a is input to the constant current circuits 11a, 11b, and 11c via the switch 15, the current values of the currents 7b-1, 7b-2, and 7b-3 are driven to be in proportion to the parallel number. As the switching signals 12a, 12b, and 12c are input to the switches 15a, 15b, and 15c, the ON period is adjusted and driven to be the reciprocal of the parallel number. The in-plane luminance is controlled such that luminance corresponding to the same dimming ratio as the dimming signal 9 input from the outside is obtained. The ON period and the OFF period are constant.

Further, if the dimming signal 9 is an analog voltage or the like rather than the pulse signal, a circuit that generates a reference signal according to a pulse based on an input signal may be set at a previous stage. Here, the example in which ON/OFF of the electric current is switched using the switch 15 has been described, but ON/OFF may be switched by setting the current value to 0.

In FIG. 1, the switching signals are generated in the order of 12a, 12b, and 12c, and thus driving is performed sequentially from the end of the display if the relation with FIG. 4 is considered, but the order of ON/OFF is not restricted as long as control is performed such that the in-plane LEDs can uniformly be driven at a time average.

Figure 9:
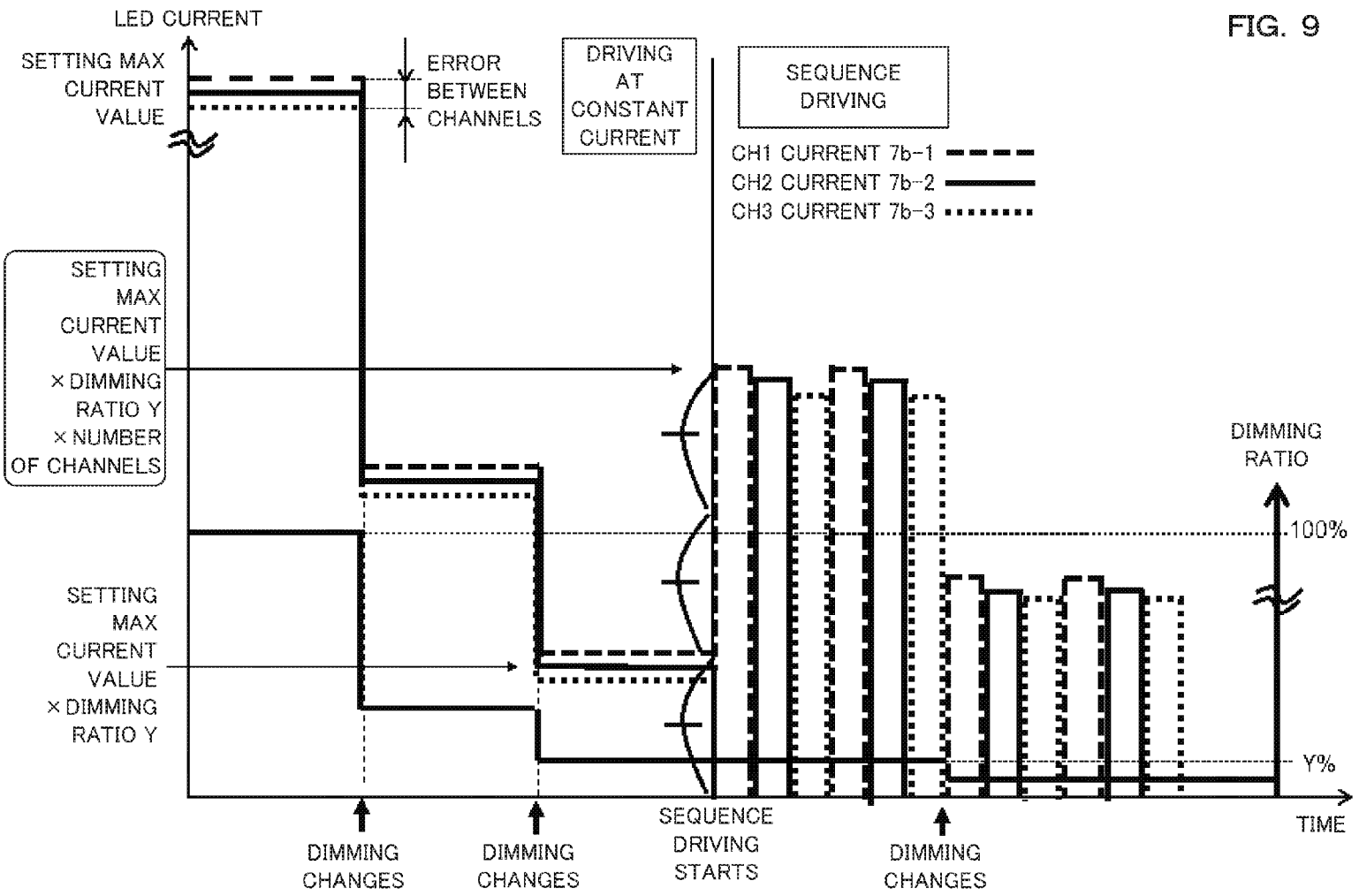
FIG. 9 is a diagram illustrating a relation between a time and an LED current/dimming ratio according to the first embodiment.

FIG. 9 illustrates a relation of a driving scheme, a dimming LED current, and luminance viewed at a time axis. In FIG. 9, a horizontal axis indicates a time, and a vertical axis indicates an LED current value and a dimming ratio. In FIG. 9, with the passage of time, the dimming ratio changes three times, and the dimming ratio decreases each time the dimming ratio changes. First, the dimming ratio is driven to be 100%, and the dimming ratio is changed to Y % by the two changes. Thereafter, the dimming ratio is changed to be smaller than Y % by the third change. Further, first, driving is performed at a constant current, and after the dimming ratio is changed twice, that is, when the dimming ratio is Y %, the sequence driving starts. At this time, as illustrated in FIG. 9, there is an error between channels in the values of the currents 7b-1, 7b-2, and 7b-3.

The LED backlight driving circuit changes the current value according to the change in the dimming ratio. When the constant current driving circuit is used, if the dimming ratio is 100%, each of the currents 7b-1, 7b-2, and 7b-3 is a setting Max current value. Thereafter, as the dimming ratio decreases, the current value decreases.

If the dimming ratio is changed to be Y % or less by the two changes, and the sequence driving starts, the currents 7b-1, 7b-2, and 7b-3 are sequentially supplied to the respective LED columns. At this time, the values of the currents 7b-1, 7b-2, and 7b-3 are set to be values obtained by multiplying the setting Max current by the dimming ratio and the number of channels (three times in FIG. 9).

As described above, in the region where the dimming ratio is Y % or less, dimming is performed with the current value proportional to the number of channels (here, three times) as illustrated in FIG. 9, and the ON period is sequentially driven to be the reciprocal of the number of channels (here, 1/3 cycle), and thus desired dimming can be performed.

<Description of Effects of First Embodiment>

Figure 10:
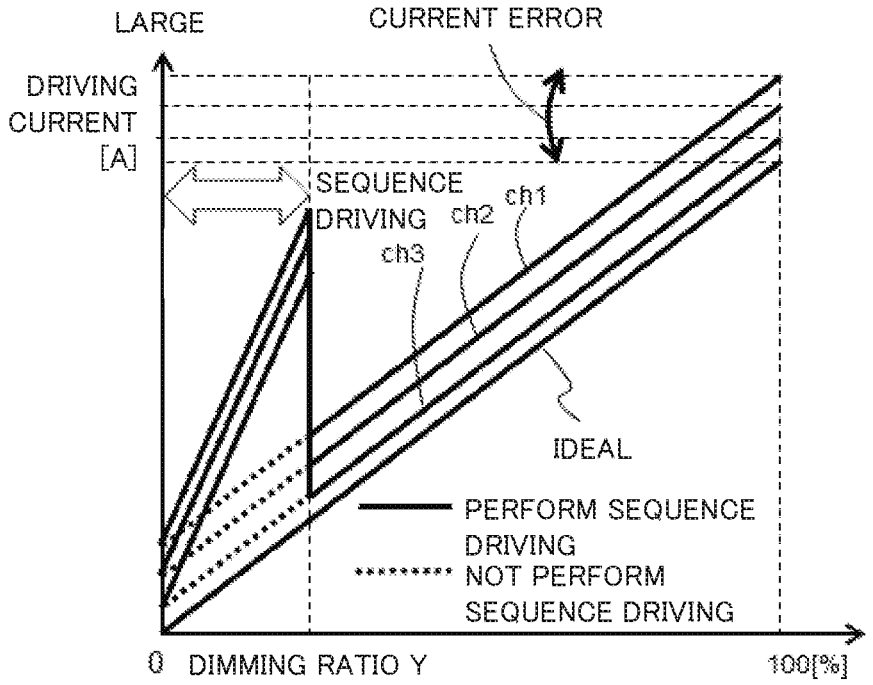
FIG. 10 is a diagram illustrating a relation between a dimming ratio and a driving current according to the first embodiment.
Figure 11:
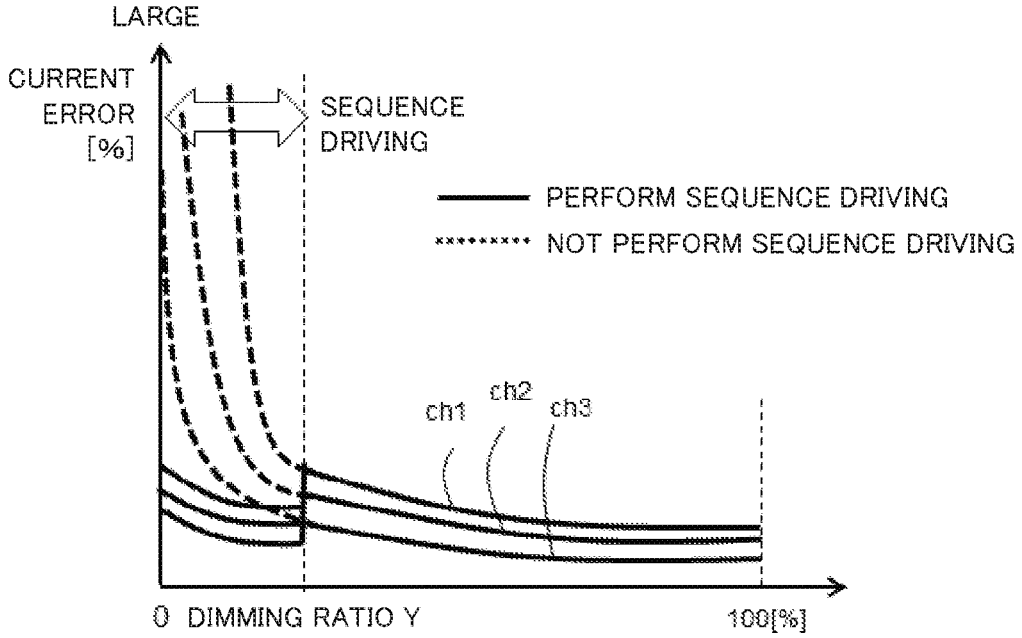
FIG. 11 is a diagram illustrating a relation between a dimming ratio and a current error according to the first embodiment.

The relation between the dimming ratio and the LED driving current according to the configuration of the first embodiment is illustrated in FIG. 10, and the relation between the dimming ratio and the error of the LED driving current is illustrated in FIG. 11. A solid line indicates the case where the sequence driving of the first embodiment is performed when the dimming ratio is Y % or less, and a dotted line indicates the case where driving is performed based on only the constant current dimming without performing the sequence driving. If the sequence driving of the first embodiment is performed at the time of low dimming of Y % or less, a current error with respect to an ideal value is relatively smaller than if not performed. In other words, the error between the constant current circuits decreases, and thus the in-plane luminance difference can be suppressed.

Further, in the first embodiment, even when the parallel number of the LED circuits is large, it is enough by only sequential driving, and thus control is simple. Further, since sequential driving is performed at only the low dimming side, even if the parallel number of the LED circuits is increased, the luminance does not decrease, and it is possible to suppress the in-plane luminance difference caused by the current difference while maintaining the existing luminance design.

Further, the power change of the entire circuit viewed at the time axis is not repetition of ON/OFF of electric power as in the PWM but consistently constant, and thus a noise or a ringing sound is unlikely to occur. Further, the backlight does not repeat lighting and extinction as in the PWM, and some LEDs are constantly in the lighting state, and thus flickering or ripples are unlikely to occur.

Second Embodiment

<Configuration of Second Embodiment>

Figure 12:
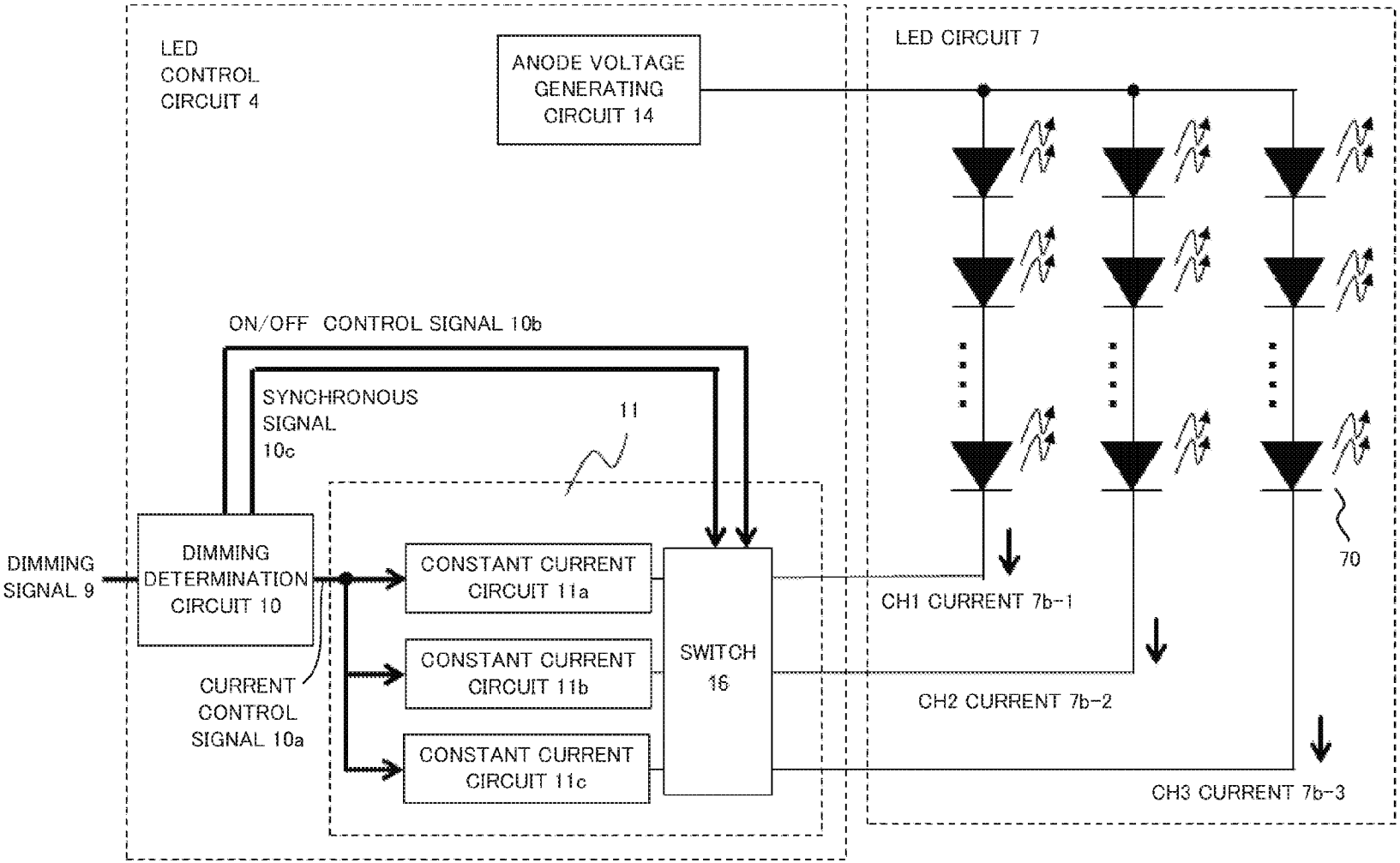
FIG. 12 is a diagram illustrating a configuration of an example of LED backlight driving circuit according to a second embodiment.

FIG. 12 is a diagram illustrating a configuration of an LED backlight driving circuit according to a second embodiment. A different point with FIG. 1 lies in that the sequence control circuit is not installed, and a switch 16 is installed at a stage behind the constant current circuit 11 instead of the switch 15 at the stage ahead of the constant current circuit 11. Further, the ON/OFF control signal 10b and the synchronous signal 10c from the dimming determination circuit 10 are input to the switch 16. The switch 16 installed behind the constant current circuit 11 operates as a switch of switching a connection between the constant current circuits 11*a*-11*c* and the LED circuit 7.

Figure 13:
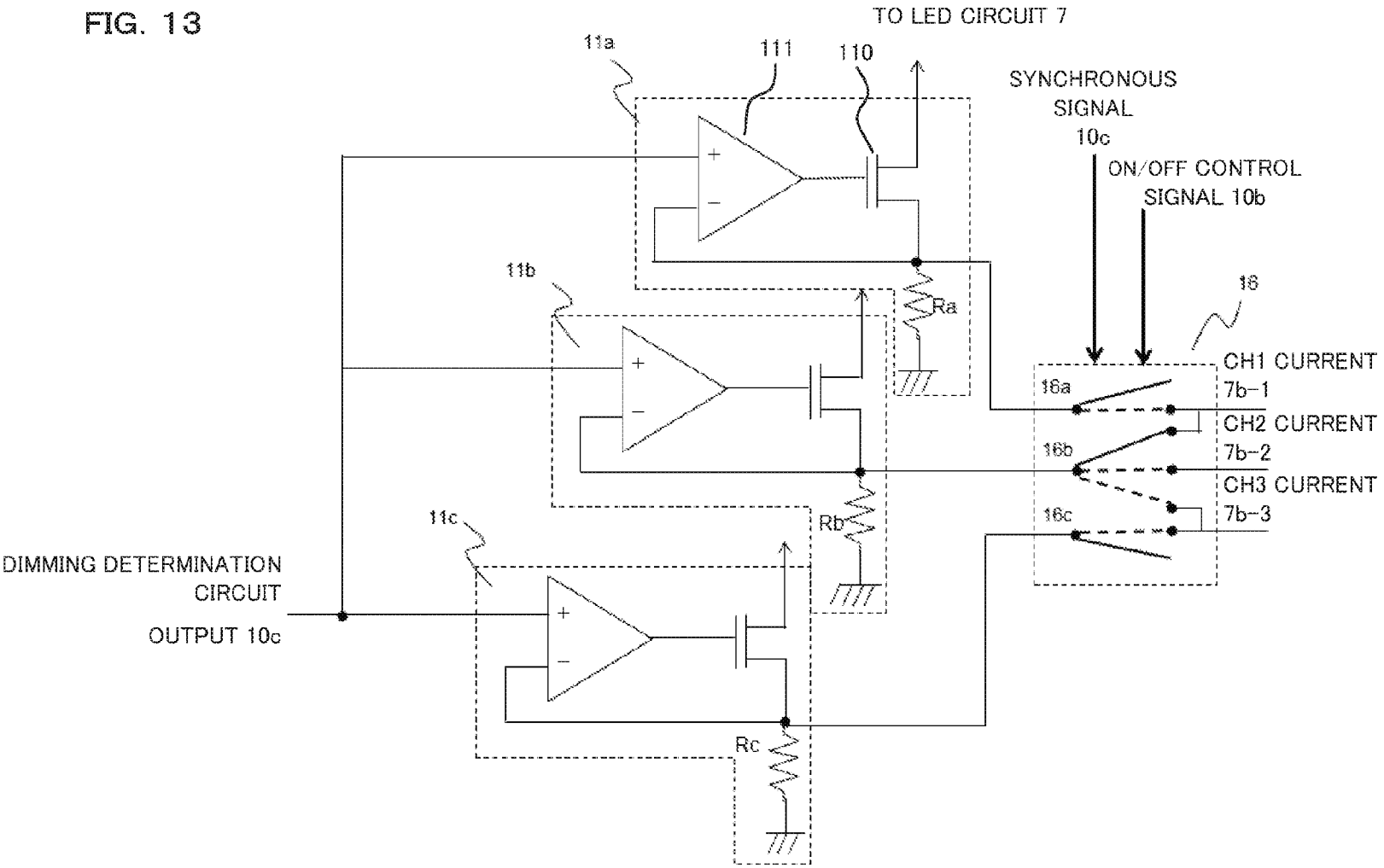
FIG. 13 is a detailed diagram of a constant current circuit according to the second embodiment.

FIG. 13 illustrates the details of the constant current circuit 11. A constant current circuit 11*a* includes an FET 110 and an operational amplifier 111, similarly to the first embodiment, and the constant current circuits 11*b* and 11*c* have the same structure as the constant current circuit 11*a*. The FET and the operational amplifier of each of the constant current circuits 11*b* and 11*c* have the same configuration as the FET 110 and the operational amplifier 111, and reference numerals thereof are omitted. The operations of the constant current circuits 11*a*, 11*b*, and 11*c* are similar to the first embodiment, and thus a description thereof is omitted. The subsequent stages of the constant current circuits 11*a*, 11*b*, and 11*c* are connected with 7*b*-1, 7*b*-2, and 7*b*-3 serving as ch1, ch2, and ch3 currents via the switch 16, and outputs of the constant current circuits 11*a*, 11*b*, and 11*c* are connected with switches 16*a*, 16*b*, and 16*c*, respectively. The ON/OFF control signal 10*b* and the synchronous signal 10*c* from the dimming determination circuit 10 are input to the switch 16. In the switch 16, the switch 16*a* has an ON/OFF function of a connection between the constant current circuit 11*a* and the ch1 current 7*b*-1, and the switch 16*b* has a switching function of the constant current circuit 11*b* and the ch1, ch2, and ch3 currents 7*b*-1, 7*b*-2, and 7*b*-3. The switch 16*c* has an ON/OFF function of a connection between the constant current circuit 11*c* and the ch3 current 7*b*-3.

<Description of Operation of Second Embodiment>

Figure 14:
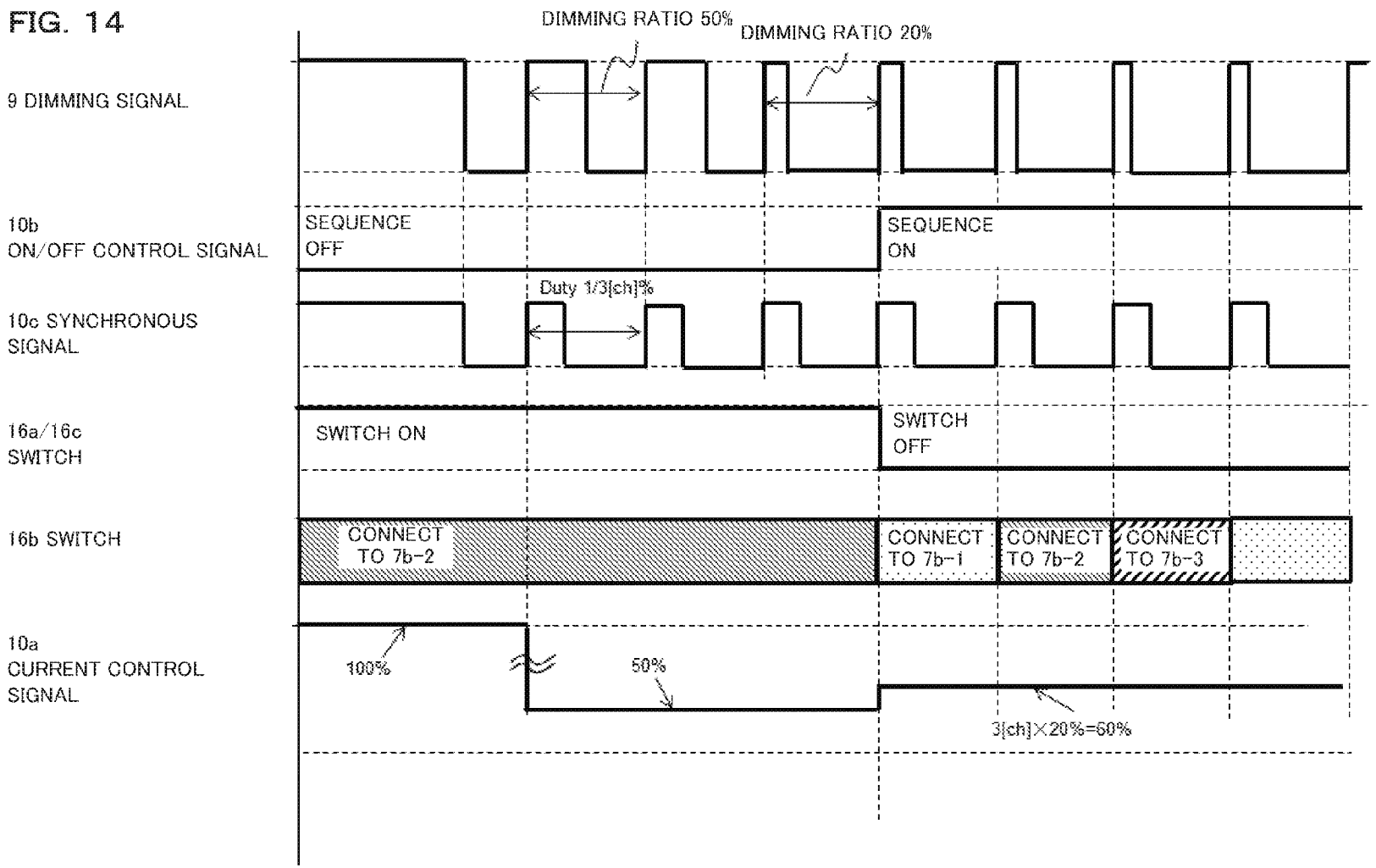
FIG. 14 is a timing chart (1/2) according to the second embodiment.
Figure 15:
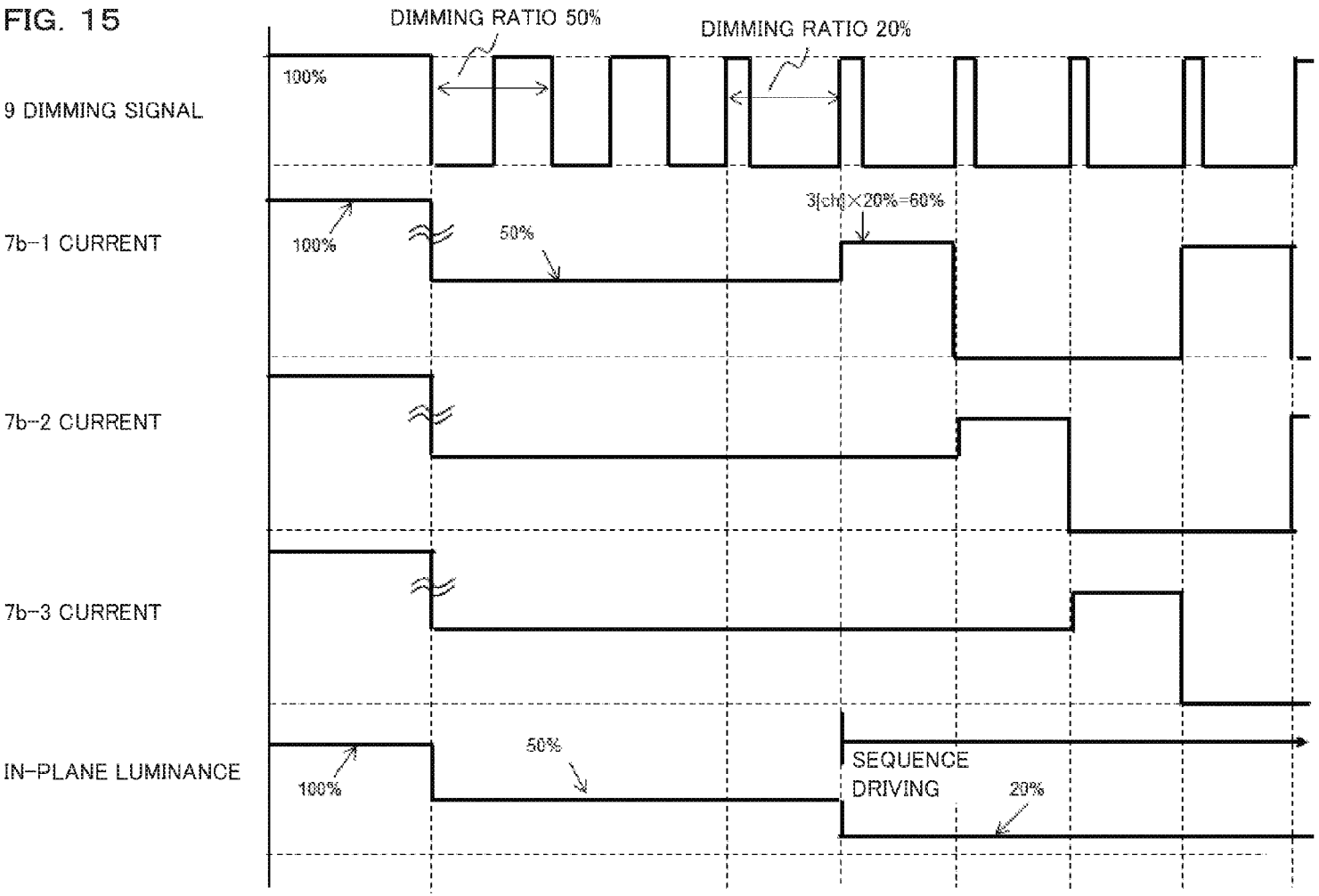
FIG. 15 is a timing chart (2/2) according to the second embodiment.

FIGS. 14 and 15 illustrate an overall operation timing of the LED circuit. A timing at which the sequence driving starts is similar to the first embodiment, but the paths of the switches 16*a* and 16*c* of the switch 16 are turned off (blocked) by the ON/OFF control signal 10*b*. At the same time, sequential switching of the switch 16*b* starts. The constant current circuit 11*b* is sequentially connected with the LED column of the respective channels of the LED circuit 7, and thus the sequence driving of the electric current is performed using one constant current circuit. During the constant current operation, the switch 16*b* does not perform the sequence driving and is in the state constantly connected with the ch2 current (7*b*-2).

Figure 16:
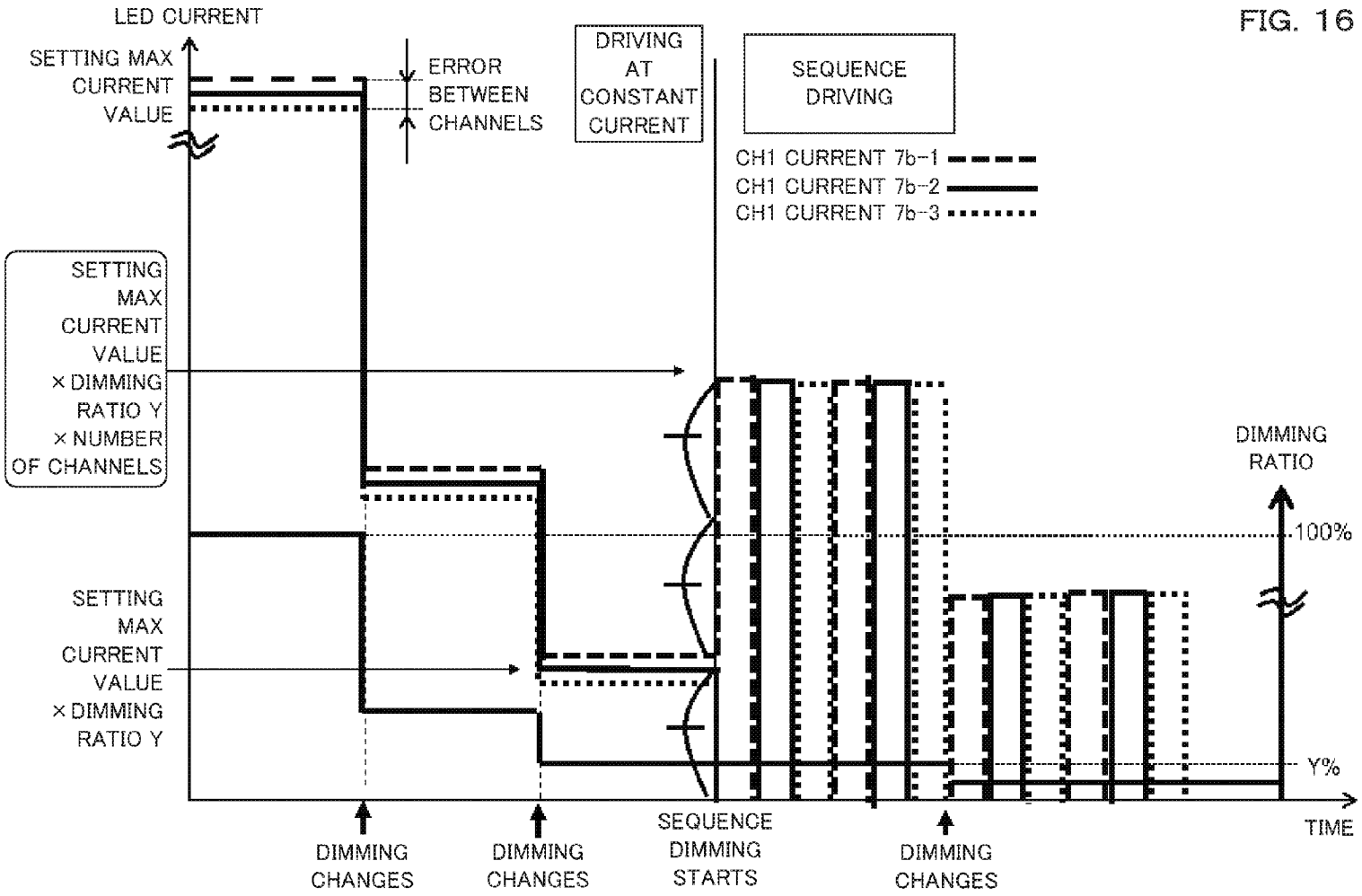
FIG. 16 is a diagram illustrating a relation between a time and an LED current/dimming ratio according to the second embodiment.

Similarly to the first embodiment, FIG. 16 illustrates a relation between the driving scheme and the dimming LED current using a horizontal axis as a time. Since in the region where the dimming ratio is Y % or less, dimming is performed with the current value proportional to the number of channels (here, three times) as illustrated in FIG. 16 and only the constant current circuit 11*b* is used, there is not error in the driving current value, and driving is performed with the same electric current sequentially in a cycle according to the reciprocal of the number of channels (here, 1/3 cycle).

<Description of Effects of Second Embodiment>

Figure 17:
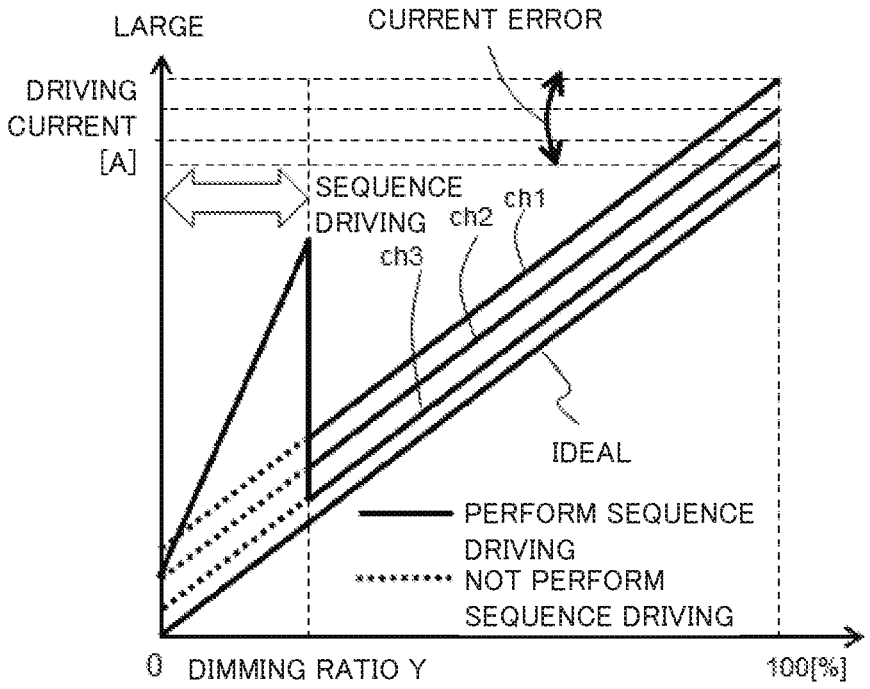
FIG. 17 is a diagram illustrating a relation between a dimming ratio and a driving current according to the second embodiment.
Figure 18:
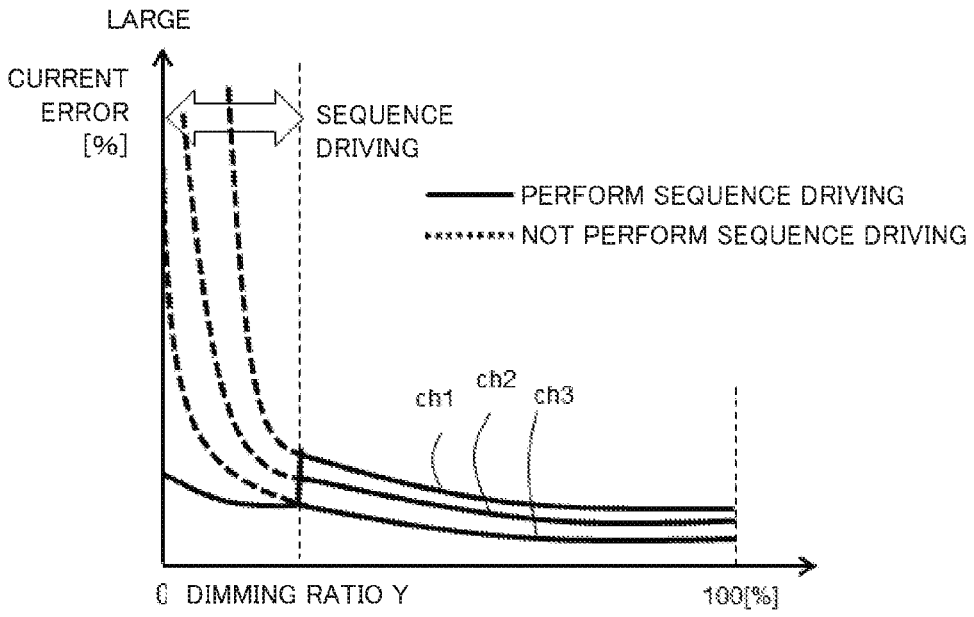
FIG. 18 is a diagram illustrating a relation between a dimming ratio and a current error according to the second embodiment.

In the second embodiment, since driving is performed by one constant current circuit, an error at the time of small current (low dimming) is suppressed, and then it is possible to remove the difference in the electric current between the constant current circuits. The relation between the dimming ratio and the LED driving current according to the configuration of the second embodiment is illustrated in FIG. 17, and the relation between the dimming ratio and the error of the LED driving current is illustrated in FIG. 18. A solid line indicates the case where the sequence driving is performed if the dimming ratio is Y % or less, and a dotted line indicates the case where driving is performed based on only the constant current dimming without performing the sequence driving. As one constant current circuit is used at the time of low dimming of Y % or less, there is no error between the constant current circuits, and it is possible to prevent the occurrence of the in-plane luminance difference. Further, as the sequence driving is performed, similarly to the first embodiment, it is possible to suppress an increase in the error at the time of low dimming.

Further, in the second embodiment, the sequence driving may be performed by switching of the switch 16*a* or the switch 16*c* instead of the switch 16*b*. Further, the sequence driving may be performed by switching of two or all of the switches 16*a*, 16*b*, and 16*c*. Furthermore, switching in the sequence driving may be controlled using the sequence control circuit 12. In addition, the sequence driving may be performed by any configuration as long as the driving current proportional to the parallel number of the LED columns can be sequentially supplied from one of the constant current circuits 11*a*, 11*b*, and 11*c* to the LED circuit 7.

Third Embodiment

<Configuration of Third Embodiment>

Figure 19:
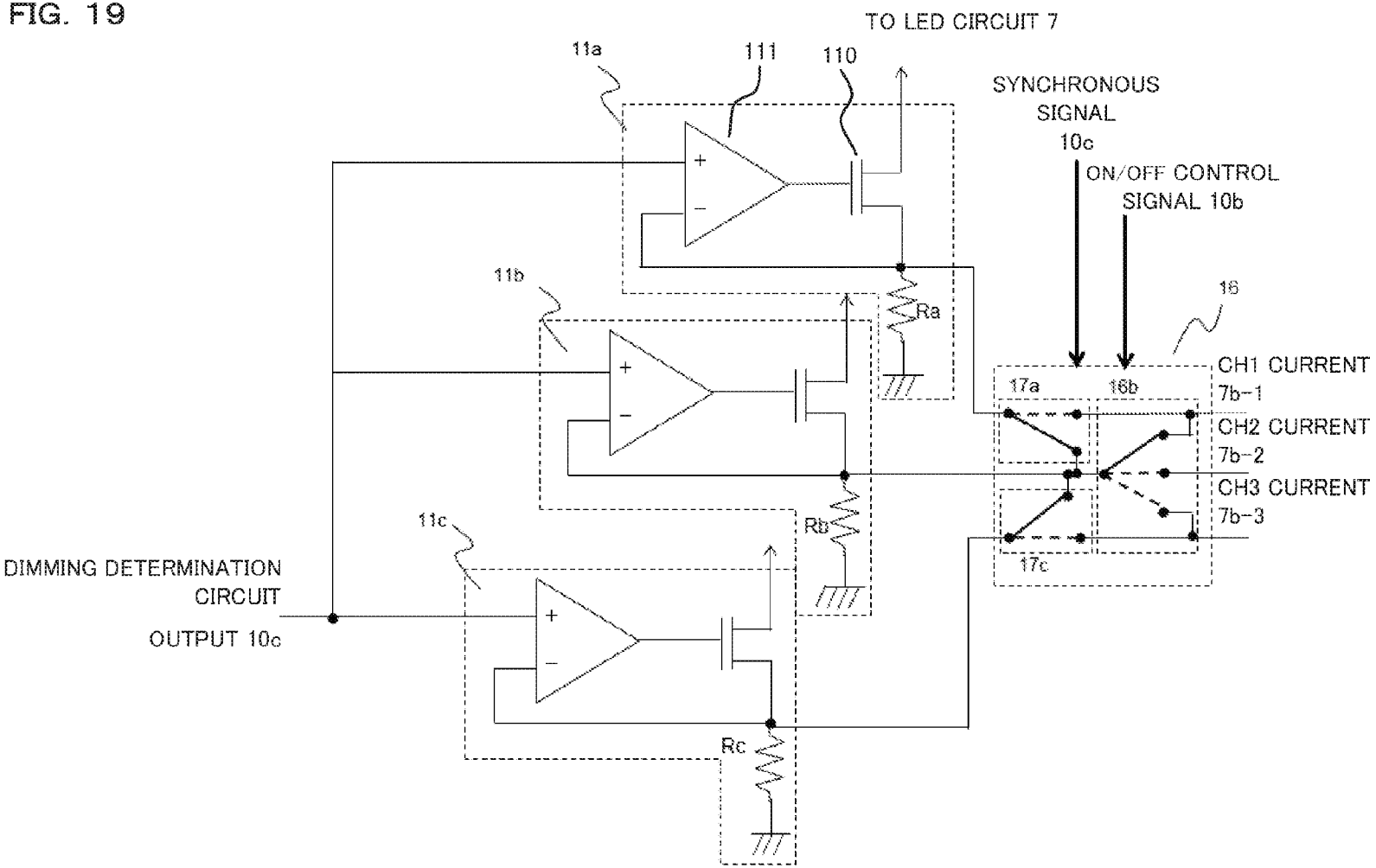
FIG. 19 is a diagram illustrating a relation between an internal configuration of a switch and a constant current circuit of an example of LED backlight driving circuit according to a third embodiment.

An LED backlight driving circuit of a third embodiment has a similar configuration to that of the second embodiment (FIG. 12), but an internal configuration of the switch 16 of the LED control circuit 4 is different. FIG. 19 is a diagram illustrating a relation between the internal configuration of the switch 16 and the constant current circuit 11 according to the third embodiment. Switches 17*a* and 17*c* are installed instead of the switches 16*a* and 16*c* of FIG. 13. The switch 17*a* is a switch that performing switching between the ch1 current 7*b*-1 and the ch2 current 7*b*-2. The switch 17*c* is a switch that performing switching between the ch2 current 7*b*-2 and the ch3 current 7*b*-3. An FET and an operational amplifier of each of the constant current circuits 11*b* and 11*c* have the same configuration as the FET 110 and the operational amplifier 111, and reference numerals thereof are omitted.

<Description of Operation of Third Embodiment>

At the time of the constant current driving, the switch 17*a* is connected with the ch1 current 7*b*-1, and the switch 17*c* is connected with the ch3 current 7*b*-3, and at the time of the sequence driving, an operation is performed such that the switches 17*a* and 17*c* are connected with the ch2 current 7*b*-2.

Figure 20:
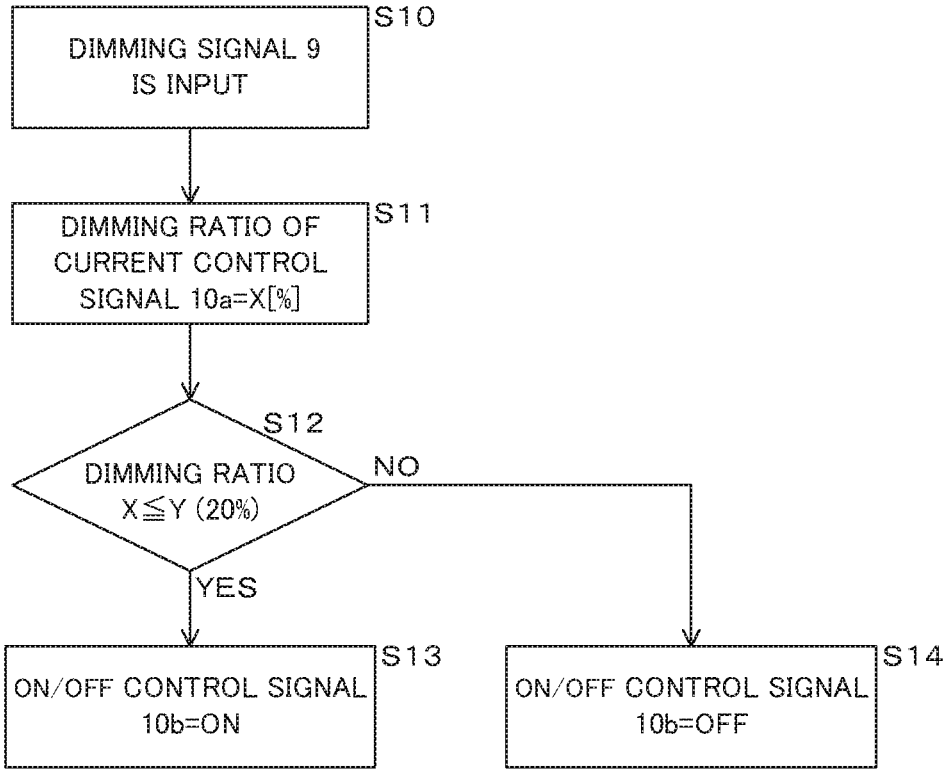
FIG. 20 is an operation flowchart of a dimming determination circuit 10 according to the third embodiment.

Thus, at the time of the sequence driving, the outputs of the constant current circuits 11*a*, 11*b*, and 11*c* overlap, the current values are added, and driving is performed with an LED current of three times. FIG. 20 illustrates an operation of the dimming determination circuit 10 of the third embodiment. Unlike the flowchart of FIG. 5 of the first embodiment, the current control signal 10*a* does not vary according to the dimming ratio, and only determination of the operation of the ON/OFF control signal 10*b* is performed.

The dimming signal 9 is input to the dimming determination circuit 10 (S10). In other words, the dimming determination circuit 10 acquires the dimming signal 9. The dimming determination circuit 10 calculates the dimming ratio X % based on the acquired dimming signal 9 (S11), and determines whether or not the dimming ratio X is equal to or less than Y [%] (here, 20%) (S12). If the dimming determination circuit 10 determines the dimming ratio X to be equal to or less than Y (S12: YES), the ON/OFF control signal 10*b* is set to ON (S13) and transferred to the sequence control circuit 12. As a result, the sequence driving is performed. If the dimming determination circuit 10 determines the dimming ratio X to be neither equal to nor less than Y (S12: NO), the ON/OFF control signal 10*b* is set to OFF (S14), the LED driving current is constantly set to ON, and the constant current driving is performed.

<Description of Effects of Third Embodiment>

Figure 21:
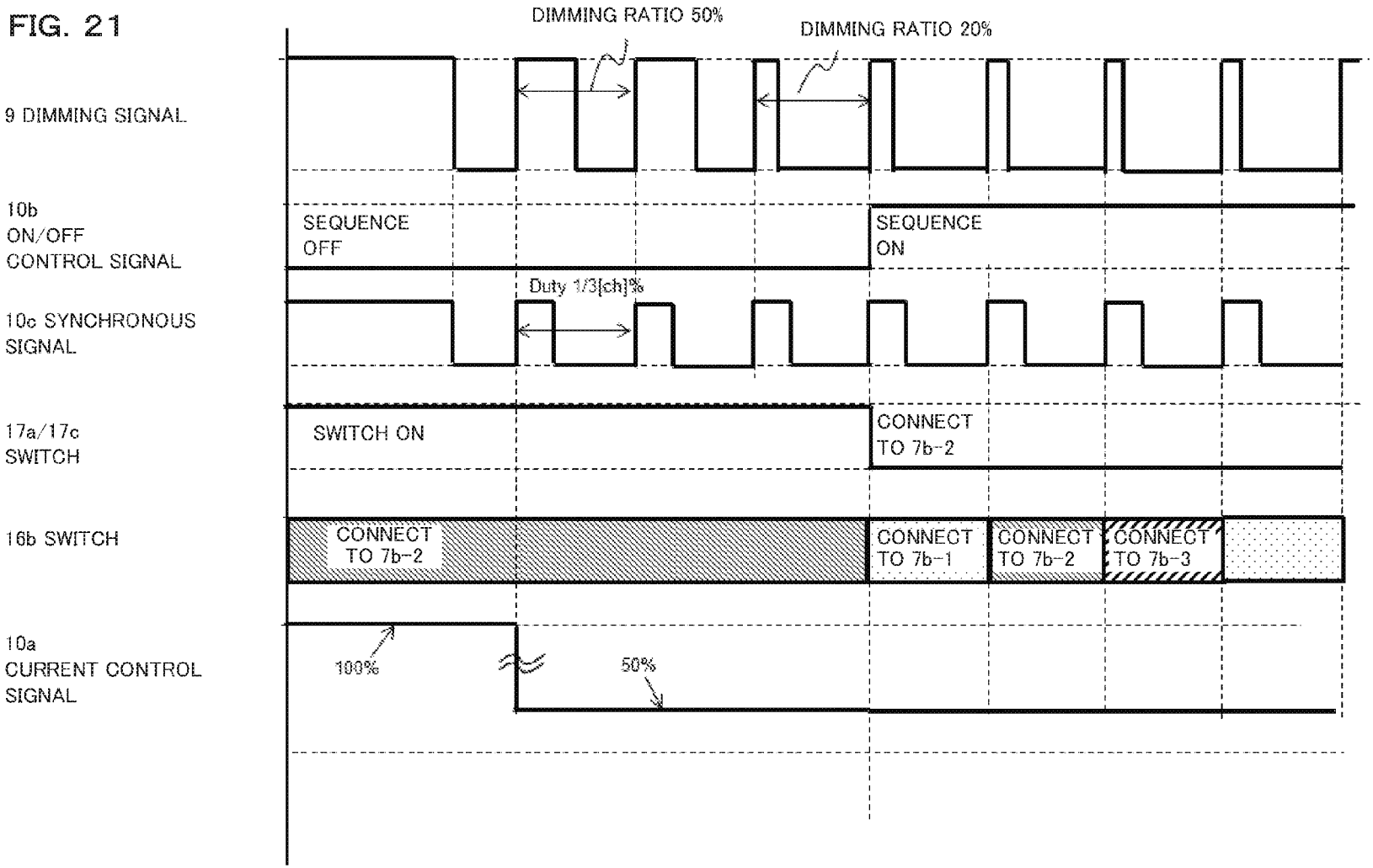
FIG. 21 is a timing chart (1/2) according to the third embodiment.
Figure 22:
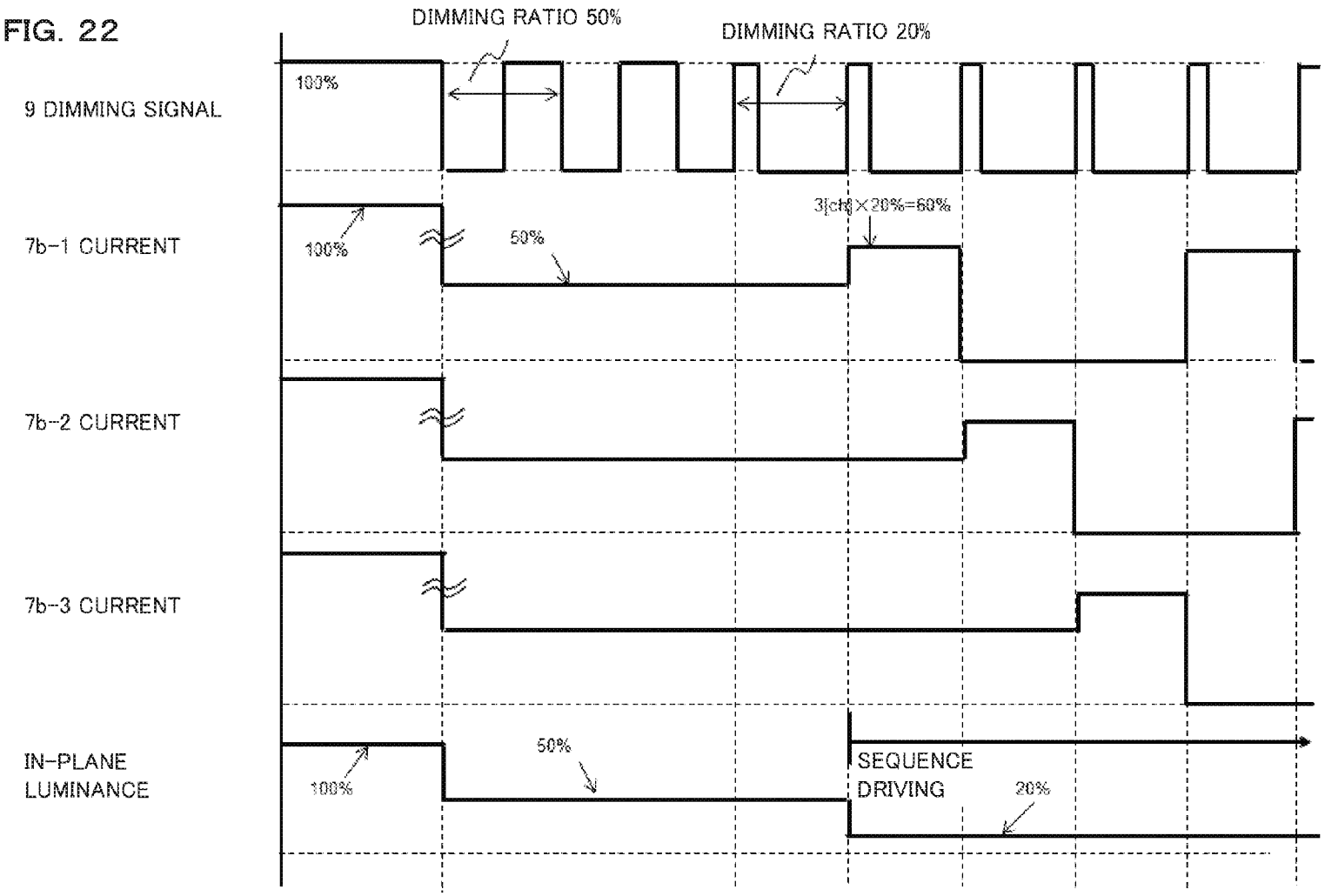
FIG. 22 is a timing chart (2/2) according to the third embodiment.

FIGS. 21 and 22 illustrate an overall operation timing of the LED circuit. The operation timing of FIGS. 21 and 22 differs from the timing chart of FIGS. 14 and 15 of the second embodiment in the operation of the current control signal 10*a*, and it becomes a constant value regardless of the driving scheme, and thus similar effects to the second embodiment are obtained.

The switch 17*a* may function as a switch that performs switching between the ch1 current 7*b*-1 and the ch3 current 7*b*-3, and the switch 17*b* that switches the connection between the constant current circuits 11*b* and the ch2 current 7*b*-2, the ch3 current 7*b*-3 may be installed instead of the switch 17*c*. At this time, the sequence driving can be performed by performing an operation such that both the switch 17*a* and the switch 17*b* are connected to the ch3 current 7*b*-3. Thus, the values of the constant current circuits 11*a*, 11*b*, and 11*c* are added, and driving can be performed with the LED current of three times.

The switch 17*c* may function as a switch that performs switching between the ch1 current 7*b*-1 and the ch3 current 7*b*-3, and the switch 17*b* that switches the connection between the constant current circuits 11*b* and the ch1 current 7*b*-1, the ch2 current 7*b*-2 may be installed instead of the switch 17*a*. At this time, the sequence driving can be performed by performing an operation such that both the switch 17*b* and the switch 17*c* are connected to the ch1 current 7*b*-1. Thus, the values of the constant current circuits 11*a*, 11*b*, and 11*c* are added, and driving can be performed with the LED current of three times.

In addition, the switch 16 may have any configuration as long as the driving current in which the outputs of all the constant current circuits 11*a*, 11*b*, and 11*c* overlap is sequentially supplied to the LED circuit 7.

In the first to third embodiments, the LED control circuit 4 includes the three constant current circuits 11*a*, 11*b*, and 11*c*, but the number of constant current circuits is not limited thereto, and two or four or more constant current circuits may be arranged according to the number of the LED groups 7*a*-1, 7*a*-2, . . . , and 7*a*-*n*.

As described above, according to the embodiment of the present disclosure, it is possible to control the in-plane luminance unevenness at the time of low dimming while utilizing the luminous efficiency of the existing backlight without increasing the number of LEDs or the maximum value of the driving current.

It should be understood that the embodiments disclosed herein are illustrative and non-restrictive in every respect. Since the scope of the present invention is defined by the appended claims rather than by the description preceding them, and all changes that fall within metes and bounds of the claims, or equivalence of such metes and bounds thereof are therefore intended to be embraced by the claims. That is, embodiments obtained by combining technique appropriately modified within the scope defined by the appended claims are also included in the technical scope of the present invention.

It is noted that, as used herein and in the appended claims, the singular forms "a", "an", "the" include plural referents unless the context clearly dictates otherwise.

What is claimed is:

1. An LED backlight driving circuit, comprising:

an LED circuit including a plurality of LED columns that are connected in parallel, each of LED column including one or more LEDs that are connected in series;

an LED control circuit connected to constant current circuits corresponding to a parallel number of the LED columns, the LED control circuit including a circuit that controls ON/OFF of a driving current of the LED and a dimming determination circuit that outputs a control signal capable of arbitrarily setting the driving current according to a dimming signal, wherein the LED control circuit includes a sequence control circuit that outputs a signal for controlling an ON/OFF period of the driving current, and performs control based on first driving in which dimming is performed by varying a current value of the driving current of the LED and second driving in which the ON/OFF of the driving current is controlled in addition to the varying of the current value.

2. The LED backlight driving circuit according to claim 1, wherein the first driving is performed if a duty ratio of the dimming signal is larger than a predetermined value, and the second driving is performed if a duty ratio of the dimming signal is equal to or less than the predetermined value.

3. The LED backlight driving circuit according to claim 1, wherein, in the second driving, the ON period and the OFF period of the driving current are constant.

4. The LED backlight driving circuit according to claim 1, wherein the second driving is performed as the driving current is sequentially supplied from one constant current circuit to the LED circuit.

5. The LED backlight driving circuit according to claim 1, wherein the second driving is performed as a driving current in which outputs of all the constant current circuits overlap is sequentially supplied to the LED circuit.

6. A liquid crystal display device, comprising:

the LED backlight driving circuit according to claim 1; and a backlight unit.

7. The LED backlight driving circuit according to claim 1, wherein, in the second driving, the ON period of the driving current is set to a reciprocal of the parallel number of the LED columns, and the LEDs arranged in parallel are sequentially driven without being turned on at the same time.

8. The LED backlight driving circuit according to claim 7, wherein the second driving is performed with a current value proportional to the parallel number with respect to a current value at a time of the same luminance as when diming is performed in the first driving.

9. The LED backlight driving circuit according to claim 7, wherein the LED has no OFF period as a whole.

10. A method of driving a driving circuit that drives a LED circuit including a plurality of LED columns that are connected in parallel, each of LED column including one or more LEDs that are connected in series, the method comprising:

acquiring a duty ratio of a dimming signal input to the driving circuit;

determining whether or not the duty ratio is equal to or less than a threshold value;

supplying a driving current of a current value set based on the duty ratio to the LED column if the duty ratio is determined to be neither equal to nor less than the threshold value; and supplying sequentially a driving current of a current value set to a current value based on a parallel number of the LED columns to the LED columns if the duty ratio is determined to be equal to or less than the threshold value.

* * * * *